US007117148B2

(12) United States Patent
Droppo et al.

(10) Patent No.: US 7,117,148 B2
(45) Date of Patent: Oct. 3, 2006

(54) METHOD OF NOISE REDUCTION USING CORRECTION VECTORS BASED ON DYNAMIC ASPECTS OF SPEECH AND NOISE NORMALIZATION

(75) Inventors: James G. Droppo, Duvall, WA (US); Li Deng, Redmond, WA (US); Alejandro Acero, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 721 days.

(21) Appl. No.: 10/117,142

(22) Filed: Apr. 5, 2002

(65) Prior Publication Data

US 2003/0191638 A1 Oct. 9, 2003

(51) Int. Cl.
*G10L 21/02* (2006.01)

(52) U.S. Cl. ..... 704/228; 704/226

(58) Field of Classification Search ..... 704/222, 704/226, 232–234, 240–241, 227, 228, 238, 704/239, 243, 256, 209
See application file for complete search history.

(56) References Cited

U.S. PATENT DOCUMENTS

| | | | | |
|---|---|---|---|---|
| 4,718,094 A | | 1/1988 | Bahl et al. | 704/256 |
| 4,918,735 A | | 4/1990 | Morito et al. | 704/233 |
| 4,980,917 A | | 12/1990 | Hutchins | 381/41 |
| 5,012,519 A | * | 4/1991 | Adlersberg et al. | 704/226 |
| 5,390,278 A | | 2/1995 | Gupta et al. | 704/243 |
| 5,583,968 A | | 12/1996 | Trompf | 395/2.41 |
| 5,590,242 A | | 12/1996 | Juang et al. | 704/245 |
| 5,604,839 A | | 2/1997 | Acero et al. | 395/2.43 |
| 5,758,022 A | | 5/1998 | Trompf et al. | 704/232 |
| 5,924,065 A | * | 7/1999 | Eberman et al. | 704/231 |
| 5,950,157 A | | 9/1999 | Heck et al. | 704/234 |
| 6,026,359 A | | 2/2000 | Yamaguchi et al. | 704/256 |
| 6,067,517 A | | 5/2000 | Bahl et al. | 704/256 |
| 6,092,045 A | * | 7/2000 | Stubley et al. | 704/254 |

(Continued)

FOREIGN PATENT DOCUMENTS

EP 0 301 199 A1 2/1989

(Continued)

OTHER PUBLICATIONS

Sameti, H. HMM-based strategies for enhancement of speech signals embedded in nonstationary noise, Sep. 1998, Speech and Audio Processing, IEEE Transaction on, vol. 6, Issue 5, p. 445-455.*

(Continued)

*Primary Examiner*—Tālivaldis Ivars Šmits
*Assistant Examiner*—Abdelali Serrou
(74) *Attorney, Agent, or Firm*—Theodore M. Magee; Westman, Champlin & Kelly, P.A.

(57) ABSTRACT

A method and apparatus are provided for reducing noise in a signal. Under one aspect of the invention, a correction vector is selected based on a noisy feature vector that represents a noisy signal. The selected correction vector incorporates dynamic aspects of pattern signals. The selected correction vector is then added to the noisy feature vector to produce a cleaned feature vector. In other aspects of the invention, a noise value is produced from an estimate of the noise in a noisy signal. The noise value is subtracted from a value representing a portion of the noisy signal to produce a noise-normalized value. The noise-normalized value is used to select a correction value that is added to the noise-normalized value to produce a cleaned noise-normalized value. The noise value is then added to the cleaned noise-normalized value to produce a cleaned value representing a portion of a cleaned signal.

7 Claims, 10 Drawing Sheets

U.S. PATENT DOCUMENTS

| | | | | |
|---|---|---|---|---|
| 6,202,047 | B1 | 3/2001 | Ephraim et al. | 704/256.6 |
| 6,292,775 | B1 | 9/2001 | Holmes | 704/209 |
| 6,301,561 | B1 | 10/2001 | Saul | 704/256 |
| 6,401,064 | B1 | 6/2002 | Saul | 704/240 |
| 6,446,038 | B1 | 9/2002 | Bayya et al. | 704/232 |
| 6,490,555 | B1 | 12/2002 | Yegnanarayanan et al. | 704/231 |
| 6,691,091 | B1 | 2/2004 | Cerisara et al. | 704/255 |
| 6,778,954 | B1 | 8/2004 | Kim et al. | 704/226 |

FOREIGN PATENT DOCUMENTS

EP 0 694 906 A1 1/1996

OTHER PUBLICATIONS

Li Deng and Jeff Ma, "Spontaneous speech recognition using a statistical coarticulatory model for the vocal-tract-resonance dynamics," J. Acoust. Soc. Am. 108(5), Pt. 1, Nov. 2002.

Jeff Ma and Li Deng, "A path-stack algorithm for optimizing dynamic regimes in a statistical hidden dynamic model of speech," *Computer Speech and Language 2000,* 00, 1-14.

U.S. Appl. No. 10/116,792, filed Apr. 5, 2002, Li Deng et al.

U.S. Appl. No. 09/688,764, filed Oct. 16, 2000, Li Deng et al.

U.S. Appl. No. 09/688,950, filed Oct. 16, 2000, Li Deng et al.

"HMM Adaption Using Vector Taylor Series for Noisy Speech Recognition," Alex Acero, et al., Proc. ICSLP, vol. 3, 2000, pp. 869-872.

"Sequential Noise Estimation with Optimal Forgetting for Robust Speech Recognition," Mohomed Afify, et al., Proc. ICASSP, vol. 1, 2001, pp. 229-232.

"High-Perfomance Robust Speech Recognition Using Stereo Training Data," Li Deng, et al., Proc. ICASSP, vol. 1, 2001, pp. 301-304.

"ALGONQUIN: Iterating Laplace's Method to Remove Multiple Types of Acoustic Distortion for Robust Speech Recognition," Brendan J. Frey, et al., Proc. Eurospeech, Sep. 2001, Aalborg, Denmark.

"Nonstationary Environment Compensation Based on Sequential Estimation," Nam Soo Kim, IEEE Signal Processing Letters, vol. 5, 1998, pp. 57-60.

"On-Line Estimation of Hidden Markov Model Parameters Based on the Kullback-Leibler Information Measure," Vikram Krishnamurthy, et al., IEEE Trans. Sig. Proc., vol. 41, 1993, pp. 2557-2573.

"A Vector Taylor Series Approach for Environment-Independent Speech Recognition," Pedro J. Moreno, ICASSP, vol. 1, 1996, pp. 733-736.

"Recursive Parameter Estimation Using Incomplete Data," D.M. Titterington, J. J. Royal Stat. Soc., vol. 46(B), 1984, pp. 257-267.

"The Aurora Experimental Framework for the Performance Evaluations of Speech Recognition Systems Under Noisy Conditions," David Pearce, et al., Proc. ISCA IIRW ASR 2000, Sep. 2000.

"Efficient On-Line Acoustic Environment Estimation for FCDCN in a Continuous Speech Recognition System," Jasha Droppo, et al., ICASSP, 2001.

"Robust Automatic Speech Recognition With Missing and Unreliable Acoustic Data," Martin Cooke, Speech Communication, vol. 34, No. 3, pp. 267-285, Jun. 2001.

"Learning Dynamic Noise Models From Noisy Speech for Robust Speech Recognition," Brendan J. Frey, et al., Neural Information Processing Systems Conference, 2001, pp. 1165-1121.

"Speech Denoising and Dereverberation Using Probabilistic Models," Hagai Attias, et al., Advances in NIPS, vol. 13, 2000 pp. 758-764.

"Statistical-Model-Based Speech Enhancement Systems," Proc. of IEEE, vol. 80, No. 10, Oct. 1992, pp. 1526.

"HMM-Based Strategies for Enhancement of Speech Signals Embedded in Nonstationary Noise," Hossein Sameti, IEEE Trans. Speech Audio Processing, vol. 6, No. 5, Sep. 1998, pp. 445-455.

"Model-based Compensation of the Additive Noise for Continuous Speech Recognition," J.C. Segura, et al., Eurospeech 2001.

"Large-Vocabulary Speech Recognition Under Adverse Acoustic Environments," Li Deng, et al., Proc. ICSLP, vol. 3, 2000, pp. 806-809.

"A Compact Model for Speaker-Adaptive Training," Anastasakos, T., et al., BBN Systems and Technologies, pp. 1137-1140 (undated).

"Suppression of Acoustic Noise in Speech Using Spectral Subtraction," Boll, S. F., IEEE Transactions on Acoustics, Speech and Signal Processing, vol. ASSP-27, No. 2, pp. 113-120 (Apr. 1979).

"Experiments With a Nonlinear Spectral Subtractor (NSS), Hidden Markov Models and the Projection, for Robust Speech Recognition in Cars," Lockwood, P. et al., Speech Communication 11, pp. 215-228 (1992).

"A Spectral Subtraction Algorithm for Suppression of Acoustic Noise in Speech," Boll, S.F., IEEE International Conference on Acoustics, Speech & Signal Processing, pp. 200-203 (Apr. 2-4, 1979).

"Enhancement of Speech Corrupted by Acoustic Noise," Berouti, M. et al., IEEE International Conference on Acoustics, Speech & Signal Processing, pp. 208-211 (Apr. 2-4, 1979).

"Acoustical and Environmental Robustness in Automatic Speech Recognition," Acero, A., Department of Electrical and Computer Engineering, Carnegie Mellon University, pp. 1-141 (Sep. 13, 1990).

"Speech Recognition in Noisy Environments," Moreno, P., Department of Electrical and Computer Engineering, Carnegie Mellon University, pp. 1-130 (Apr. 22, 1996).

"A New Method for Speech Denoising and Robust Speech Recognition Using Prohabilistic Models for Clean Speech and for Noise," Hagai Attias, et al., Proc. Eurospeech, 2001, pp. 1903-1906.

Ephraim, Yariv, "On the Application of Hidden Markov Models for Enhancing Noisy Speech," IEEE ICASSP vol. 1, conf. 13, p. 533-536, 1988.

Moreno, Pedro J., "Multivariate-Gaussian-Based Cepstral Normalization for Robust Speech Recognition," Proceedings of ICASSP, p. 137-140, 1995.

Neumeyer, L. and Weintraub, M. "Probabilistic Optimum Filtering For Robust Speech Recognition," Acoustic, Speech and Signal Processing, ICASSP-94, p. 417-420, Apr. 1994.

* cited by examiner

METHOD OF NOISE REDUCTION USING CORRECTION VECTORS BASED ON DYNAMIC ASPECTS OF SPEECH AND NOISE NORMALIZATION

BACKGROUND OF THE INVENTION

The present invention relates to noise reduction. In particular, the present invention relates to removing noise from signals used in pattern recognition.

A pattern recognition system, such as a speech recognition system, takes an input signal and attempts to decode the signal to find a pattern represented by the signal. For example, in a speech recognition system, a speech signal (often referred to as a test signal) is received by the recognition system and is decoded to identify a string of words represented by the speech signal.

To decode the incoming test signal, most recognition systems utilize one or more models that describe the likelihood that a portion of the test signal represents a particular pattern. Examples of such models include Neural Nets, Dynamic Time Warping, segment models, and Hidden Markov Models.

Before a model can be used to decode an incoming signal, it must be trained. This is typically done by measuring input training signals generated from a known training pattern. For example, in speech recognition, a collection of speech signals is generated by speakers reading from a known text. These speech signals are then used to train the models.

In order for the models to work optimally, the signals used to train the model should be similar to the eventual test signals that are decoded. In particular, the training signals should have the same amount and type of noise as the test signals that are decoded.

Typically, the training signal is collected under "clean" conditions and is considered to be relatively noise free. To achieve this same low level of noise in the test signal, many prior art systems apply noise reduction techniques to the testing data.

In one technique for removing noise, the prior art identifies a set of correction vectors from a stereo signal formed of two channel signals, each channel containing the same pattern signal. One of the channel signals is "clean" and the other includes additive noise. Using feature vectors that represent frames of these channel signals, a collection of noise correction vectors are determined by subtracting feature vectors of the noisy channel signal from feature vectors of the clean channel signal. When a feature vector of a noisy pattern signal, either a training signal or a test signal, is later received, a suitable correction vector is added to the feature vector to produce a noise reduced feature vector.

This stereo-based technique for generating correction vectors has in the past utilized only static descriptions of the pattern signals. Thus, the correction, vectors have not incorporated the dynamic nature of pattern signals such as speech. As a result, the sequences of noise-reduced feature vectors tend to include a large number of discontinuities between neighboring feature vectors. In other words, the changes between neighboring noise-reduced feature vectors are not as smooth as in normal speech.

In addition, the stereo-based correction does not perform optimally if a noise in an input signal was not found in the training data. When this occurs, the system attempts to find the closest correction vector. However, since the noise was not found in the training data, the correction vector will not adequately remove the noise. In fact, in areas of the input signal where the signal-to-noise ratio is low, the correction vector can actually worsen the noise in the input signal.

In light of this, a noise reduction technique is needed that is more effective at removing noise from pattern signals.

SUMMARY OF THE INVENTION

A method and apparatus are provided for reducing noise in a signal. The noise reduction technique converts a frame of a noisy signal into a noisy feature vector. A correction vector is then selected based on the noisy feature vector. The selected correction vector incorporates dynamic aspects of pattern signals. Under some embodiments, the dynamic aspects are incorporated as dynamic coefficients in the correction vector. In other embodiments, the dynamic aspects are incorporated by passing correction vectors through a filter. In still further embodiments, the dynamic aspects are incorporated by selecting the correction vector based on a sequence of noisy feature vectors instead of based on a single noisy feature vector. Once selected, the correction vector is added to the noisy feature vector to produce a cleaned feature vector.

Under a second aspect of the invention, noise in a noisy signal is estimated and a value representing the noise is subtracted from a value representing the noisy signal. This creates a noise-normalized value, which is used to identify a correction value. The correction value is added to the noise-normalized value to produce a cleaned noise-normalized value. The value representing the noise is then added to the cleaned noise-normalized value to produce a value representing a cleaned signal.

DETAILED DESCRIPTION OF ILLUSTRATIVE EMBODIMENTS

Figure 1:
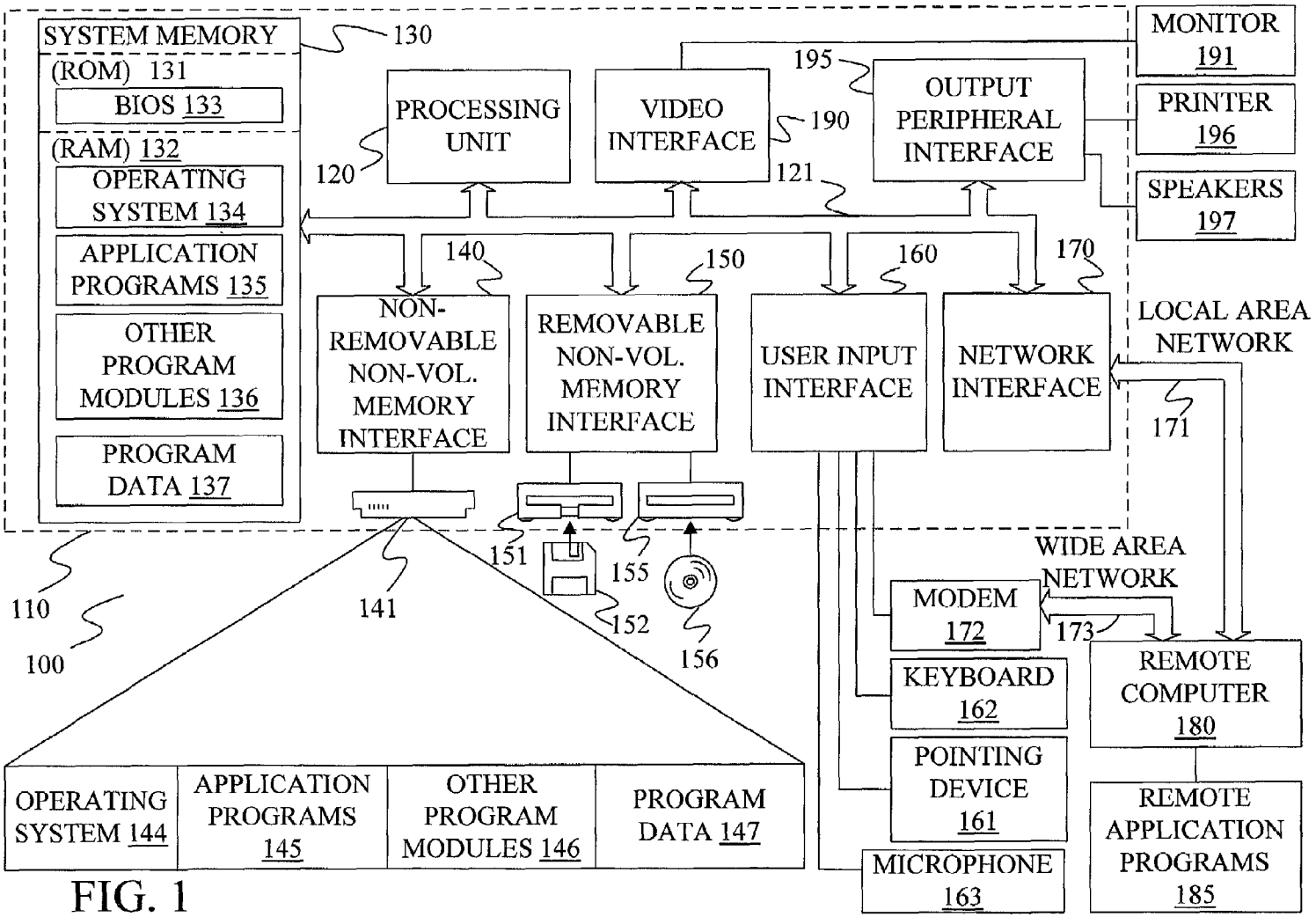
FIG. 1 is a block diagram of one computing environment in which the present invent on may be practiced.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132 A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk- drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 190.

The computer 110 may operate in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
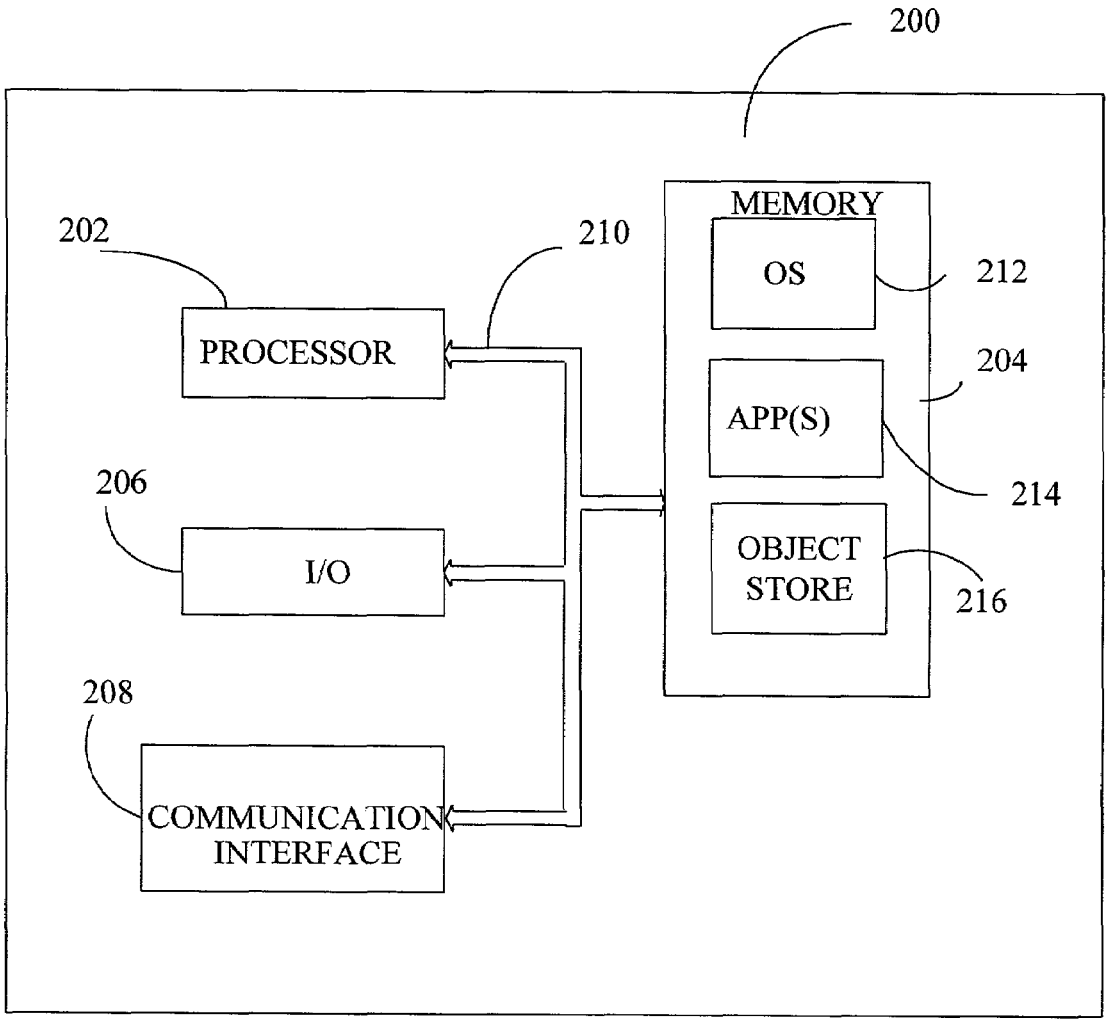
FIG. 2 is a block diagram of an alternative computing environment in which the present invention may be practiced.

FIG. 2 is a block diagram of a mobile device 200, which is an exemplary computing environment. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212, in one preferred embodiment, is a WINDOWS® CE brand operating system commercially available from Microsoft Corporation. Operating system 212 is preferably designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Mobile device 200 can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, and a microphone as well as a variety of output devices including an audio generator, a vibrating device, and a display. The devices listed above are by way of example and need not all be present on mobile device 200. In addition, other input/output devices may be attached to or found with mobile device 200 within the scope of the present invention.

Under one aspect of the present invention, a system and method are provided that reduce noise in pattern recognition signals. To do this, the present invention identifies a collection of correction vectors, $r_k$, that incorporate dynamic aspects of the pattern signal. These correction vectors are then added to a feature vector representing a portion of a noisy pattern signal to produce a feature vector representing a portion of a "clean" pattern signal.

A method for training the correction vectors under one embodiment of the present invention is described below with reference to the flow diagram of FIG. 3 and the block diagram of FIG. 4. A method of applying the correction vectors to noisy feature vectors is described below with reference to the flow diagram of FIG. 5.

Figure 3:
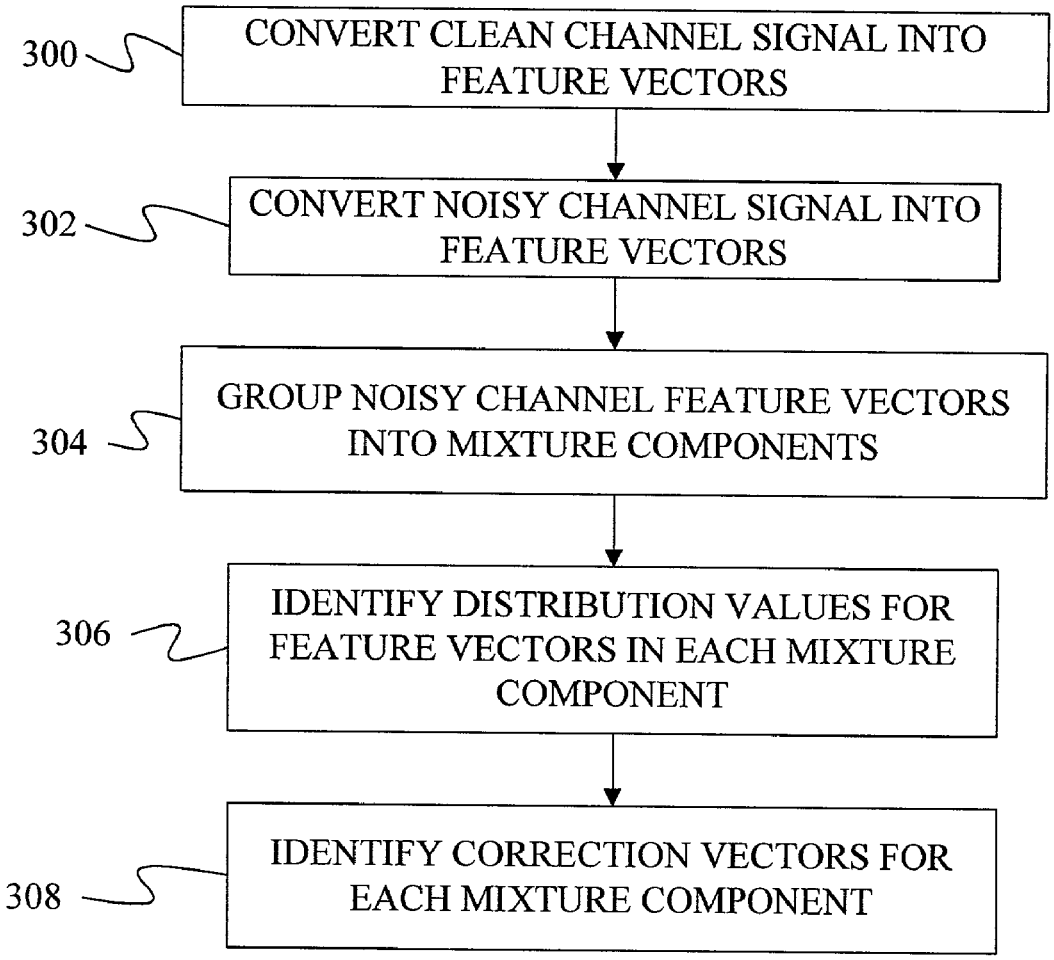
FIG. 3 is a flow diagram of a method of training a noise reduction system under one embodiment of the present invention.

The method of training correction vectors begins in step 300 of FIG. 3, where a "clean" channel signal is converted into a sequence of feature vectors. To do this, a speaker 400 of FIG. 4, speaks into a microphone 402, which converts the audio waves into electrical signals. The electrical signals are then sampled by an analog-to-digital converter 404 to generate a sequence of digital values, which are grouped into frames of values by a frame constructor 406. In one embodiment, A-to-D converter 404 samples the analog signal at 16 kHz and 16 bits per sample, thereby creating 32 kilobytes of speech data per second and frame constructor 406 creates a new frame every 10 milliseconds that includes 25 milliseconds worth of data.

Each frame of data provided by frame constructor 406 is converted into a feature vector by a feature extractor 408. In one embodiment, each feature vector includes a set of static coefficients that describe the static aspects of a frame of speech, a set of delta coefficients that describe current rates of change of the static coefficients, and a set of acceleration coefficients that describe the current rates of change of the delta coefficients. Thus, the feature vectors capture the dynamic aspects of the input speech signal by indicating how the speech signal is changing over time. Methods for identifying such feature vectors are well known in the art and include 39-dimensional Mel-Frequency Cepstrum Coefficients (MFCC) extraction with 13 static coefficients, 13 delta coefficients and 13 acceleration coefficients.

In step 302 of FIG. 3, a noisy channel signal is converted into feature vectors. Although the conversion of step 302 is shown as occurring after the conversion of step 300, any part of the conversion may be performed before, during or after step 300 under the present invention. The conversion of step 302 is performed through a process similar to that described above for step 300.

Figure 4:
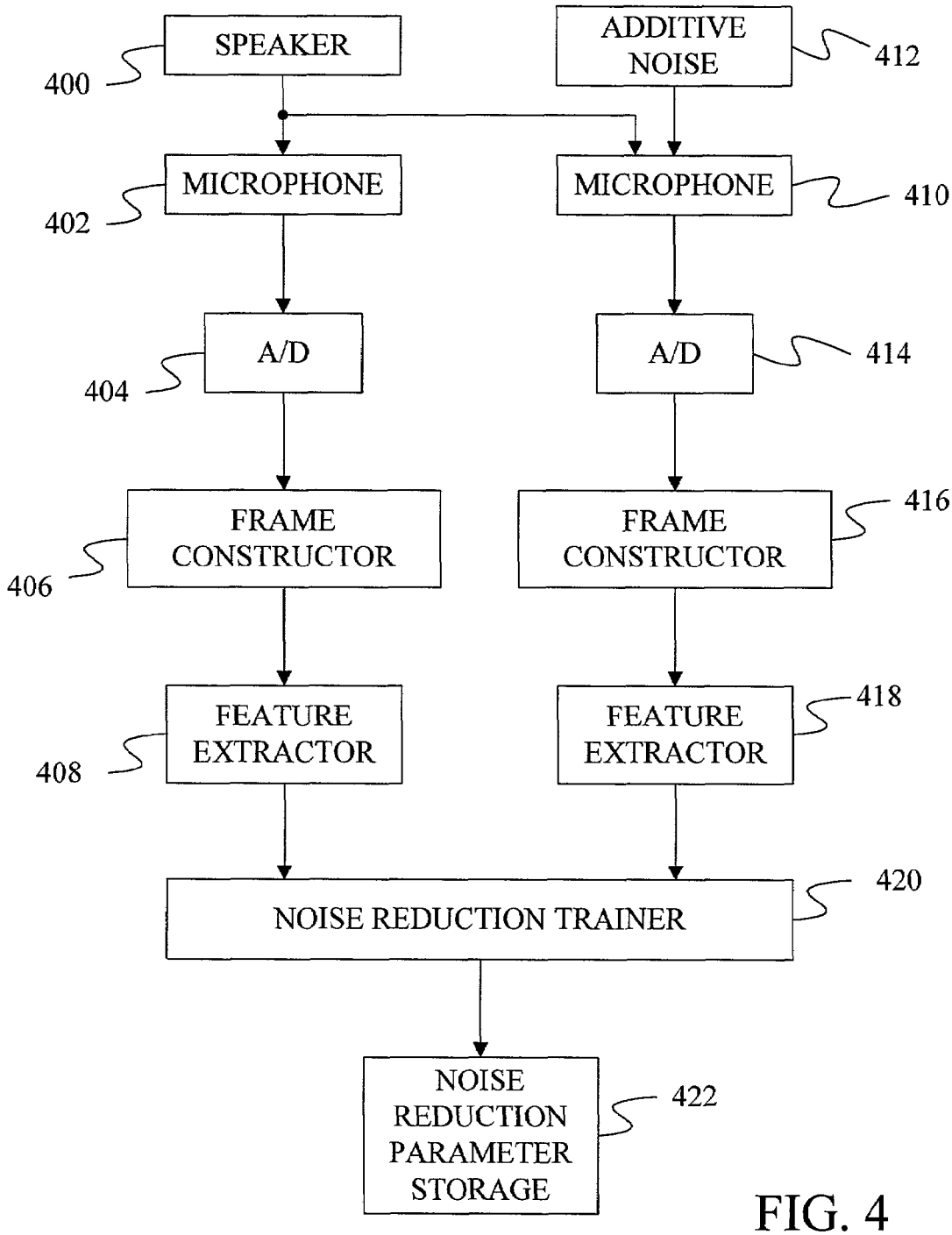
FIG. 4 is a block diagram of components used in one embodiment of the present invention to train a noise reduction system.

In the embodiment of FIG. 4, the process of step 302 begins when the same speech signal generated by speaker 400 is provided to a second microphone 410. This second microphone also receives an additive noise signal from an additive noise source 412. Microphone 410 converts the speech and noise signals into a single electrical signal, which is sampled by an analog-to-digital converter 414. The sampling characteristics for A/D converter 414 are the same as those described above for A/D converter 404. The samples provided by A/D converter 414 are collected into frames by a frame constructor 416, which acts in a manner similar to frame constructor 406. These frames of samples are then converted into feature vectors by a feature extractor 418, which uses the same feature extraction method as feature extractor 408.

In other embodiments, microphone 410, A/D converter 414, frame constructor 416 and feature extractor 418 are not present. Instead, the additive noise is added to a stored version of the speech signal at some point within the processing chain formed by microphone 402, A/D converter 404, frame constructor 406, and feature extractor 408. For example, the analog version of the "clean" channel signal may be stored after it is created by microphone 402. The original "clean" channel signal is then applied to A/D converter 404, frame constructor 406, and feature extractor 408. When that process is complete, an analog noise signal is added to the stored "clean" channel signal to form a noisy analog channel signal. This noisy signal is then applied to A/D converter 404, frame constructor 406, and feature extractor 408 to form the feature vectors for the noisy channel signal.

In other embodiments, digital samples of noise are added to stored digital samples of the "clean" channel signal between A/D converter 404 and frame constructor 406, or frames of digital noise samples are added to stored frames of "clean" channel samples after frame constructor 406. In still further embodiments, the frames of "clean" channel samples are converted into the frequency domain and the spectral content of additive noise is added to the frequency-domain representation of the "clean" channel signal. This produces a frequency-domain representation of a noisy channel signal that can be used for feature extraction.

The feature vectors for the noisy channel signal and the "clean" channel signal are provided to a noise reduction trainer 420 in FIG. 4. At step 304 of FIG. 3, noise reduction trainer 420 groups the feature vectors for the noisy channel signal into mixture components. This grouping can be done by grouping similar noisy feature vectors together using a maximum likelihood training technique or by grouping feature vectors that represent a temporal section of the speech signal together. Those skilled in the art will recognize that other techniques for grouping the feature vectors may be used and that the two techniques listed above are only provided as examples.

After the feature vectors of the noisy channel signal have been grouped into mixture components, noise reduction trainer 420 generates a set of distribution values that are indicative of the distribution of the feature vectors within the mixture component. This is shown as step 306 in FIG. 3. In many embodiments, this involves determining a mean vector and a standard deviation vector for each vector component in the feature vectors of each mixture component. In an embodiment in which maximum likelihood training is used to group the feature vectors, the means and standard deviations are provided as by-products of identifying the groups for the mixture components.

Once the means and standard deviations have been determined for each mixture component, the noise reduction trainer 420 determines a correction vector, $r_k$, for each mixture component, k, at step 308 of FIG. 3. Under one embodiment, the vector components of the correction vector for each mixture component are determined using a weighted least squares estimation technique. Under this technique, the correction vector components are calculated as:

$$r_{i,k} = \frac{\sum_{t=0}^{T-1} p(k|y_t)(x_{i,t} - y_{i,t})}{\sum_{t=0}^{T-1} p(k|y_i)} \qquad \text{EQ. 1}$$

Where $r_{i,k}$ is the $i^{th}$ vector component of a correction vector, $r_k$, for mixture component k, $y_{i,t}$ is the $i^{th}$ vector component for the feature vector $y_t$ in the $t^{th}$ frame of the noisy channel signal, $x_{i,t}$ is the $i^{th}$ vector component for the feature vector in the $t^{th}$ frame of the "clean" channel signal, T is the total number of frames in the "clean" and noisy channel signals, and $p(k|y_t)$ is the probability of the $k^{th}$ mixture component given the feature vector for the $t^{th}$ frame of the noisy channel signal. Equation 1 is calculated for each mixture component in the model. As a result, the correction vector has static coefficients, delta coefficients and acceleration coefficients and therefore incorporates dynamic aspects of speech.

In equation 1, the $p(k|y_t)$ term provides a weighting function that indicates the relative relationship between the $k^{th}$ mixture component and the current frame of the channel signals.

The $p(k|y_t)$ term can be calculated using Bayes' theorem as:

$$p(k|y_t) = \frac{p(y_t|k)p(k)}{\sum_{all\ k} p(y_t|k)p(k)} \qquad \text{EQ. 2}$$

Where $P(y_t|k)$ is the probability of the noisy feature vector given the $k^{th}$ mixture component, and p(k) is the probability of the $k^{th}$ mixture component.

The probability of the noisy feature vector given the $k^{th}$ mixture, component, $p(y_t|k)$ can be determined using a normal distribution based on the distribution values determined for the $k^{th}$ mixture component in step 306 of FIG. 3. In one embodiment, the probability of the $k^{th}$ mixture component, p(k), is simply the inverse of the number of mixture components. For example, in an embodiment that has 256 mixture components, the probability of any one mixture component is 1/256.

After a correction vector has been determined for each mixture component at step 308, the process of training the noise reduction system of the present invention is complete. The correction vectors and distribution values for each mixture component are then stored in a noise reduction parameter storage 422 of FIG. 4.

Once a correction vector has been determined for each mixture, the vectors may be used in a noise reduction technique of the present invention. In particular, the correction vectors may be used to remove noise in a training signal and/or test signal used in pattern recognition.

Figure 5:
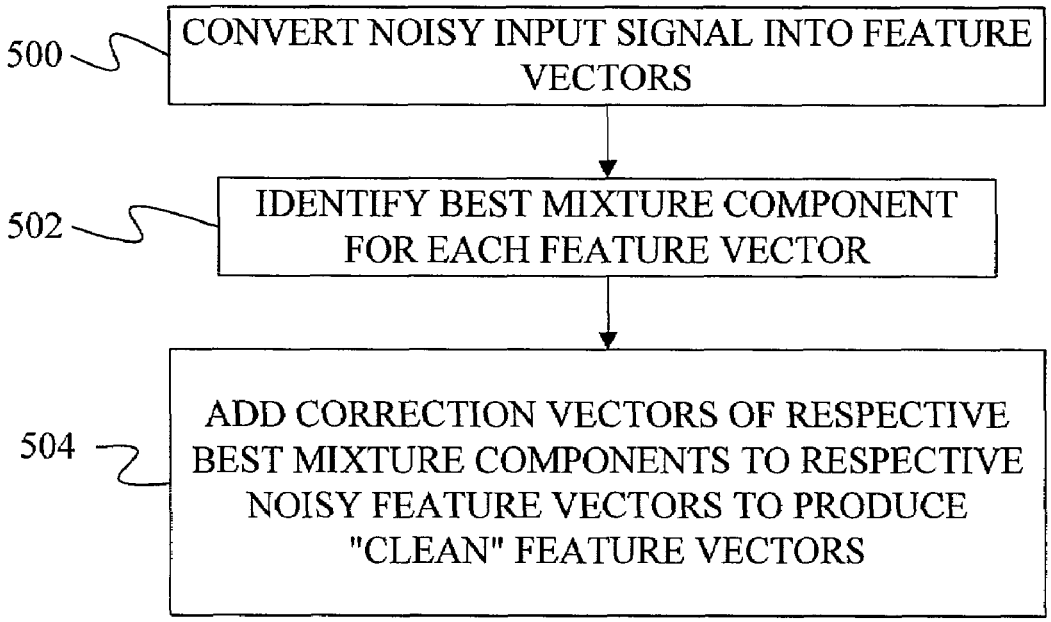
FIG. 5 is a flow diagram of a method of using a noise reduction system under one embodiment of the present invention.

FIG. 5 provides a flow diagram that describes the technique for reducing noise in a training signal and/or test signal. The process of FIG. 5 begins at step 500 where a noisy training signal or test signal is converted into a series of feature vectors where each feature vector includes static coefficients, delta coefficients and acceleration coefficients. The noise reduction technique then determines which mixture component best matches each noisy feature vector at step 502. This is done by applying the noisy-feature vector to a distribution of noisy channel feature vectors associated with each mixture component. In one embodiment, this distribution is a collection of normal distributions defined by the mixture component's mean and standard deviation vectors. The mixture component that provides the highest probability for the noisy feature vector is then selected as the best match for the feature vector. This selection is represented in an equation as:

$$\hat{k}=arg_k\max c_kN(y;\mu_k,\Sigma_k) \quad \text{EQ. 3}$$

Where $\hat{k}$ is the best matching mixture component, $c_k$ is a weight factor for the $k^{th}$ mixture component, $N(y;\mu_k,\Sigma_k)$ is the value for the individual noisy feature vector, y, from the normal distribution generated for the mean vector, $\mu_k$, and the standard deviation vector, $\Sigma_k$, of the $k^{th}$ mixture component. In most embodiments, each mixture component is given an equal weight factor $c_k$.

Once the best mixture component for each input feature vector has been identified at step 502, the corresponding correction vector for those mixture components is (element-by-element) added to the individual feature vectors to form "clean" feature vectors. In terms of an equation:

$$x_i=y_i+r_{i,k} \quad \text{EQ. 4}$$

Where $x_i$ is the $i^{th}$ vector component of an individual "clean" feature vector, $y_i$ is the $i^{th}$ vector component of an individual noisy feature vector from the input signal, and $r_{i,k}$ is the $i^{th}$ vector component of the correction vector, optimally selected for the individual noisy feature vector. The operation of Equation 4 is repeated for each vector component. Thus, Equation 4 can be re-written in vector notation as:

$$x=y+r_k \quad \text{EQ. 5}$$

where x is the "clean" feature vector, y is the noisy feature vector, and $r_k$ is the correction vector.

In a second embodiment of the present invention, the dynamic aspects of speech are incorporated into the correction vector by selecting the correction vector based on a plurality of noisy feature vectors.

Figure 6:
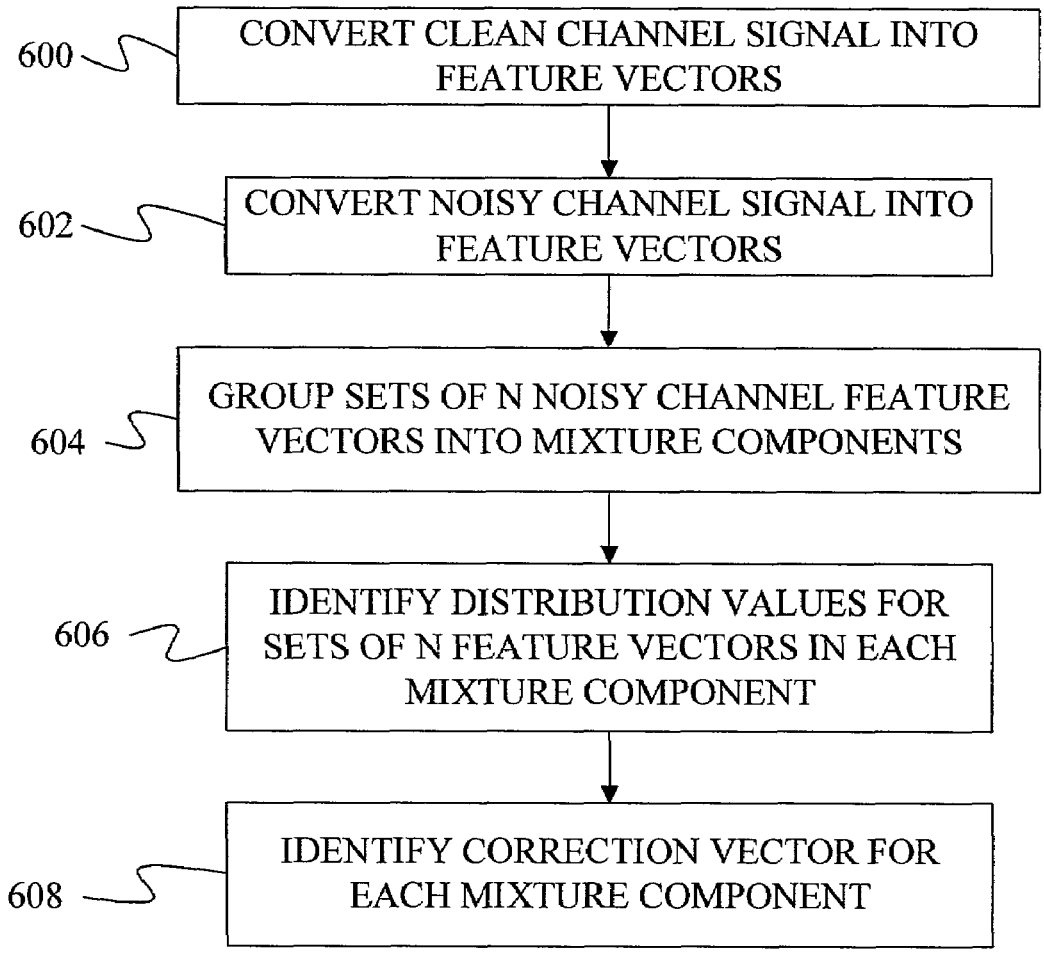
FIG. 6 is a flow diagram of a method of training a noise reduction system under a second embodiment of the present invention.

The operation of such an embodiment is shown in FIG. 6. In steps 600 and 602 of FIG. 6, a clean channel signal and a noisy channel signal are converted into sequences of feature vectors by feature extractors 408 and 418. In this embodiment, feature extractors 408 and 418 only need to produce static coefficients. However, it is contemplated that they may optionally produce delta coefficients or acceleration coefficients.

After the feature vectors have been formed, sets of n feature vectors from the noisy channel are grouped into mixture components in step 604. Thus, where n is three, triples of feature vectors are grouped into mixture components. This grouping can be done by grouping similar triples of feature vectors together using a maximum likelihood training technique or by using other techniques known to those skilled in the art.

In step 606, a set of distribution values is determine for each mixture component that describe the distribution of the sets of feature vectors in the mixture component. For example, when n equals three, the distribution values describe the distribution of triples in each mixture component. In many embodiments, this example would involve determining a mean triple of vectors and a standard deviation triple of vectors.

Once the distribution values have been determined, a correction vector is determined for each mixture component at step 608. Under one embodiment, a single correction vector is determined for each mixture component by using equation 1 above with $p(k|y_{t-n}, \ldots, y_{t-1}, y_t)$—representing the probability of a mixture component given a set of n noisy training feature vectors—being substituted for $p(k|y_t)$. Because the correction vectors are based on more than one noisy training feature vector, they incorporate dynamic information found in the training speech signal.

Figure 7:
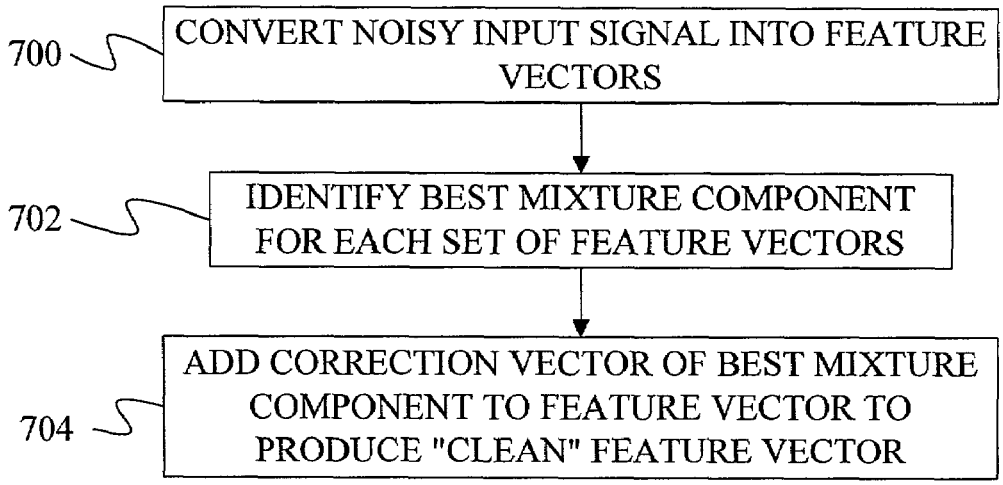
FIG. 7 is a flow diagram of a method of using a noise reduction system of the second embodiment of the present invention.

Once a correction vector has been determined for each mixture, the vectors may be used in a noise reduction technique as shown in FIG. 7. In step 700 of FIG. 7 a noisy signal is converted into feature vectors using the same technique as steps 600 and 602. Using overlapping sets of n feature vectors, a most likely mixture component is identified for each set by applying the n feature vectors to the distribution values associated with each mixture component at step 702. The mixture component that provides the highest probability for the set of n noisy feature vectors is selected as the best match for the set and the correction vector associated with the selected mixture component is added to the last noisy feature vector in the set at step 704. This produces a noise reduced feature vector for each set.

In a third embodiment, the dynamic nature of speech is incorporated in the correction vectors by smoothing the correction vectors over time. In particular, the correction vectors are smoothed by applying them to a filter that is trained based on probabilistic knowledge of the dynamic, time-varying properties of speech gathered from a set of training data.

In one embodiment, the filter is an infinite impulse response, time-varying filter, which is the solution to an objective function of cleaned speech, constrained by the probabilistic knowledge from the training data. To form the filter, a sequence of distributions on the correction vector, $r_t$, and its first difference, $r_t-r_{t-1}$, must determined from the training data. This can be accomplished by dividing the training data into sets of utterances each having T frames. For each utterance, the correction vector $r_t$ at frame t in the utterance is determined. The distribution of correction vectors $r_t$ is then determined across all of the utterances. Similarly, the distribution of the first differences at each frame t is determined. The result is T distributions for the correction vector and T distributions for the first difference, with each distribution for the correction vectors defined by a mean $\hat{s}_t$ and a variance $$\sigma^2_{\hat{s}_t},$$

and each distribution for the first difference defined by a mean $\hat{d}_t$ and a variance $$\sigma^2_{\hat{d}_t}.$$

Once these values are trained, the filter can be implemented using a forward-backward recursion. Before the recursion begins, the filter is initialized using a sequence of initial correction vectors determined using the process of FIG. 5 above. (Note, the delta and acceleration parameters do not need to be present in this embodiment). At each frame, t, this initialization involves the following calculations:

$$\mu_t = \frac{r_t}{\hat{\sigma}^2_{\hat{s}_t}} \quad \text{EQ. 6}$$

$$v_t = \hat{\sigma}^2_{\hat{d}_t} + \hat{\sigma}^2_{\hat{d}_{t+1}} + \frac{1}{\hat{\sigma}^2_{\hat{s}_t}} \quad \text{EQ. 7}$$

where $\mu_t$ will eventually hold the filtered value of the correction vector.

After the filter is initialized, the forward filtering recursion progresses with the following calculations at each frame, beginning with the second frame and ending at frame T:

$$tmp = \frac{1}{\hat{\sigma}^2_{\hat{d}_t} + v_t} \quad \text{EQ. 8}$$

$$v_t = v_t + tmp * \frac{-1}{\hat{\sigma}^2_{\hat{d}_t}} \quad \text{EQ. 9}$$

$$\mu_t = \mu_t + tmp * \mu_{t-1} \quad \text{EQ. 10}$$

After the forward recursion is finished, the backward recursion is performed, beginning at frame T−1 and ending at frame 1. The backward recursion includes the following calculations:

$$tmp = \frac{1}{\hat{\sigma}^2_{\hat{d}_{t+1}} + v_{t+1}} \quad \text{EQ. 11}$$

$$\mu_t = \mu_t + \mu_{t+1} * tmp \quad \text{EQ. 12}$$

After the backward filtering recursion is done, the sequence of $\mu_t$ values contains a filtered sequence of correction vectors that incorporates dynamic aspects of speech.

In a further embodiment, the time-varying filter described above is replaced with a time-invariant filter having a transfer function of:

$$H(z) = \frac{-0.5}{(z^{-1} - 0.5)(z - 2)} \quad \text{EQ. 13}$$

Under this filter, the parameters for adjusting $\mu_t$ do not change with each frame. The parameters were selected by the inventors based on training data such that they incorporate the dynamic aspects of speech. However, they are not calculated rigorously from the correction vector distributions. As a result of the filter being time-invariant, the initialization simplifies to performing the following calculation for each frame:

$$\mu_t = \frac{r_t}{4} \quad \text{EQ. 14}$$

The forward recursion simplifies to performing the following calculation beginning at frame 2 and ending at frame T:

$$\mu_t = \mu_t + 0.5 * \mu_{t-1} \quad \text{EQ. 15}$$

Lastly, the backward recursion simplifies to performing the following calculation beginning at frame T−1 and ending at frame 1:

$$\mu_t = \mu_t + \mu_{t+1} * 0.5 \quad \text{EQ. 16}$$

Note that the parameters found in Equations 13–16 were determined heuristically and that other parameters may work as well. As such, the time-invariant embodiment of the filter is not limited to the parameters shown above.

Figure 8:
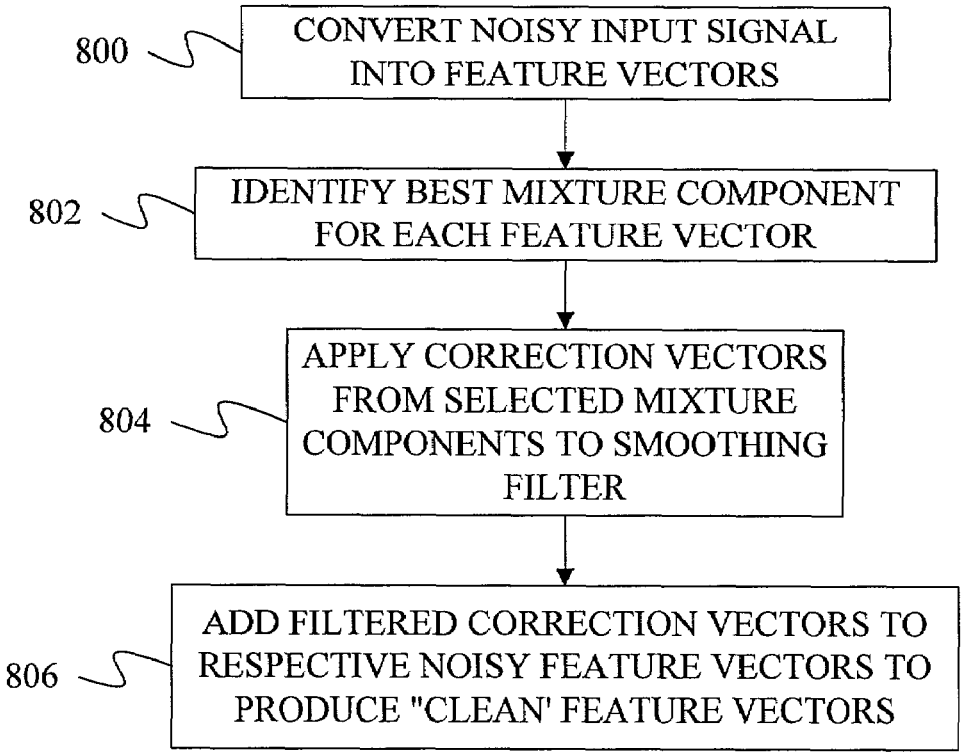
FIG. 8 is a flow diagram of a method of using a noise reduction system of a third embodiment of the present invention.

The process for using the filters described above to incorporate dynamic aspects of speech into the correction vectors is shown in FIG. 8. In step 800 of FIG. 8, the noisy signal is converted into a sequence of feature vectors.

For each feature vector, the best mixture component, and its associated correction vector, are identified at step 802. This produces a sequence of correction vectors that are applied to the filter at step 804.

The filtering performed in step 804 incorporates dynamic aspects of speech into the correction vectors because the filters are based on the static and dynamic deviations from clean speech to noisy speech found in the training data. Thus, the smoothing function performed by the filter causes the correction vectors to track the dynamic features found in speech.

After the correction vectors have been filtered, the filtered vectors are added to respective noisy feature vectors to produce "clean" feature vectors at step 806.

In a further embodiment of the present invention, the stereo-based noise reduction system is further improved using noise normalization. As noted above, stereo-based noise reduction systems of the past had difficulty processing noisy signals that were corrupted by noise that was not present in the training data. The present invention attempts to improve the handling of noise that was not present in the training data by normalizing the noise in the training data and the noise in the input noisy signal.

Figure 9:
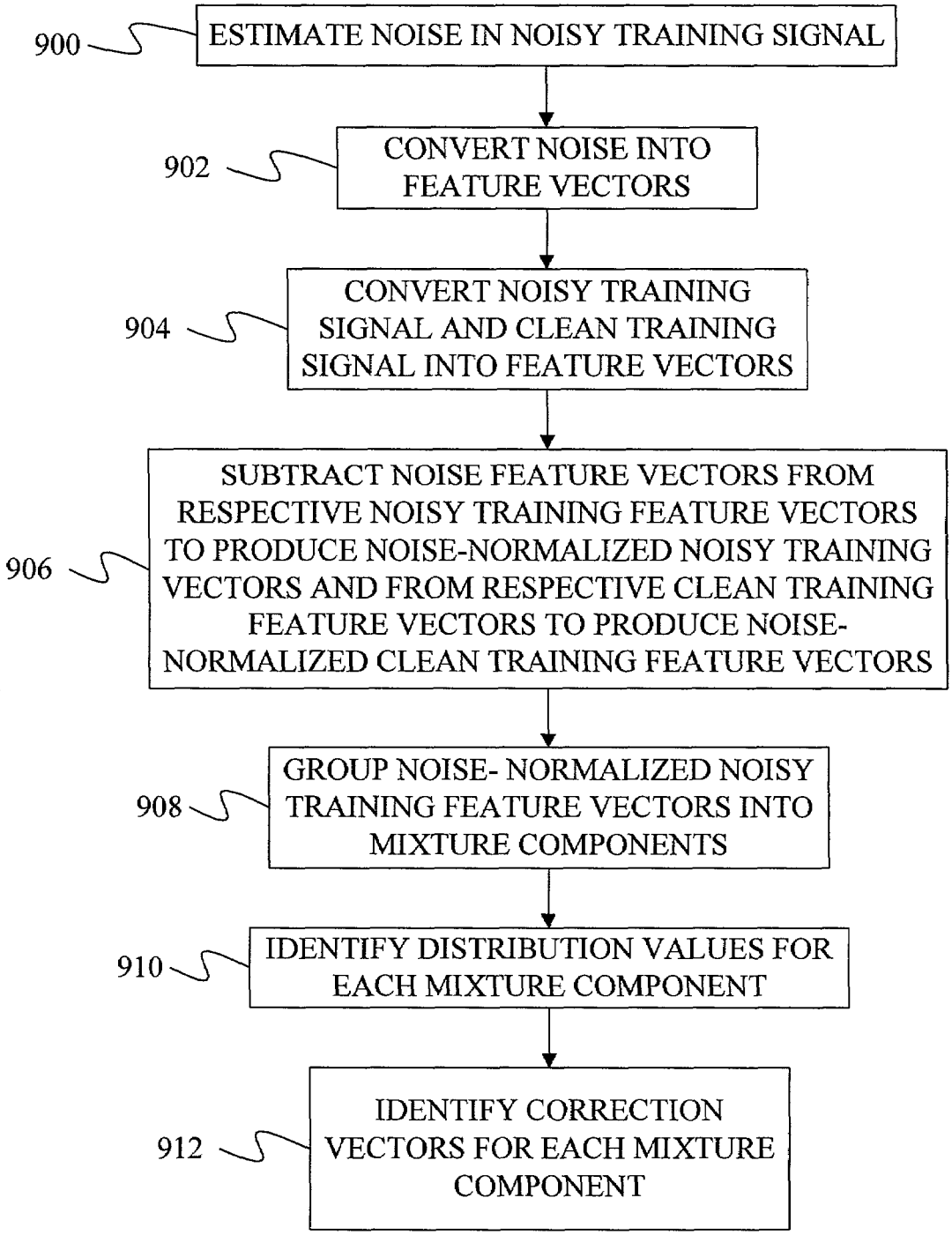
FIG. 9 is a flow diagram of a method of training a noise reduction system using noise-normalization.
Figure 10:
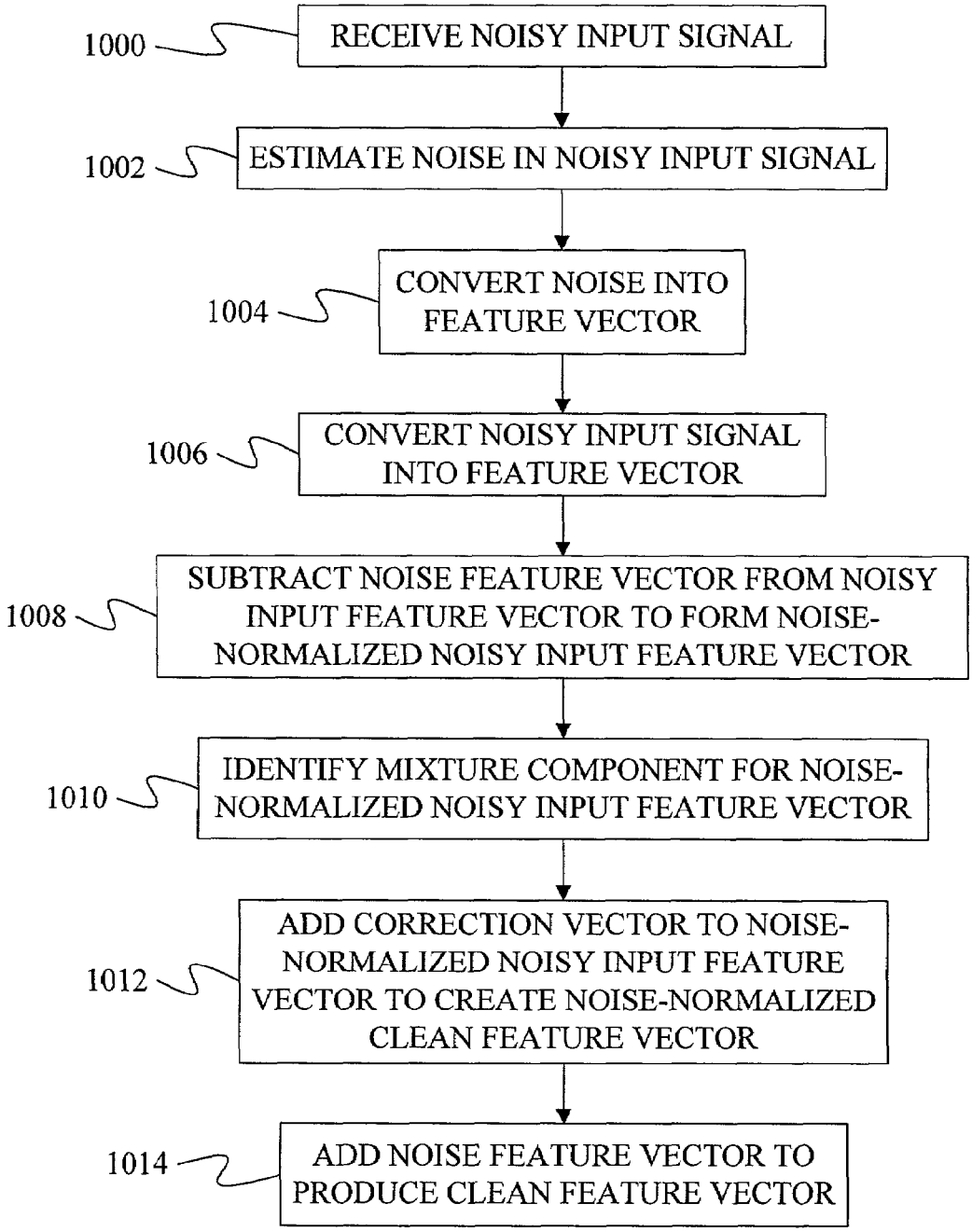
FIG. 10 is a flow diagram of a method of using a noise reduction system that employs noise-normalization

FIGS. 9 and 10 show flow diagrams for respectively training and using a stereo-based noise reduction system with noise normalization. In step 900, the noise in a noisy training signal is estimated. This can be performed in any number of known ways including estimating the noise from non-speech regions in the training signal. Note that in some embodiments, the mean of the noise across a number of frames may be used instead of determining the noise in each individual frame. In other embodiments, an iterative stochastic approximation of the noise is made using the techniques described in METHOD OF ITERATIVE NOISE ESTIMATION IN A RECURSIVE FRAMEWORK, filed on even-date herewith, having Ser. No. 10/116,792, and hereby incorporated by reference.

At step 902, the noise estimate for each frame of the noisy signal is converted into feature vectors using a feature extraction method. Under one embodiment, a cepstral feature extraction is performed by taking the log of a frequency-domain representation of frames of the signal. At step 904, each frame of the noisy training signal and the clean training signal are similarly converted into a feature vector.

Although the process of identifying the noise has been shown in FIG. 9 as occurring in the time domain, those skilled in the art will recognize that the step of estimating the noise can be performed in the feature vector domain. In such embodiments, the noisy training signal and the clean training signal are converted into feature vectors. Noise feature vectors are then estimated from the noisy training feature vectors. As a result, a noise signal is never produced in the time-domain.

For each frame of the noisy signal, the feature vector for the noise estimate of the frame is subtracted from both the feature vector for the noisy training signal and the feature vector for the clean training signal at step 906. In terms of equations:

$$\bar{x}=x-\mu \quad \text{EQ. 7}$$

$$\bar{y}=y-\mu \quad \text{EQ. 8}$$

where $\mu$ is the feature vector of the noise estimate, x is the feature vector of the clean training signal, y is the feature vector for the noisy training signal, $\bar{x}$ is the feature vector for the noise-normalized clean training signal, and $\bar{y}$ is the feature vector for the noise-normalized noisy training signal.

At step 908, the feature vectors for the noise-normalized noisy training signal are grouped into mixture components in a manner similar to that described above in step 304 of FIG. 3. Distribution values are then determined for each mixture component at step 910. A correction vector for each mixture component is determined at step 912 in a manner similar to that described for step 308 above.

After step 912 has been performed for each frame of the training signals, the noise reduction system is sufficiently trained to remove noise from an incoming signal.

In FIG. 10, the noise removal process begins at step 1000 where the noisy input signal is received. At step 1002, the noise in each frame of the input signal is estimated. Each estimate is then converted into a feature vector at step 1004. In addition, the respective frame of the noisy input signal is converted into a feature vector at step 1006. Note, as discussed above for FIG. 9, the step of estimating the noise does not have to be performed in the time-domain. Instead, the noise feature vector can be estimated directly from the noisy feature vector produced for the noisy input signal.

In step 1008, the feature vector for the noise is subtracted from the feature vector for the noisy input signal to produce a noise-normalized input feature vector. The noise-normalized feature vector is applied to the distribution parameters of the mixture components in step 1010 to identify a mixture component that best matches the noise-normalized value.

The correction vector associated with the selected mixture component is added to the noise-normalized input feature vector at step 1012 to produce a noise-normalized clean feature vector. This feature vector is then added to the noise feature vector formed in step 1004 to generate a "clean" feature vector at step 1014.

Through the process of FIGS. 9 and 10 the performance of the stereo-based noise reduction system is improved, particularly in non-speech regions of the input signal.

Figure 11:
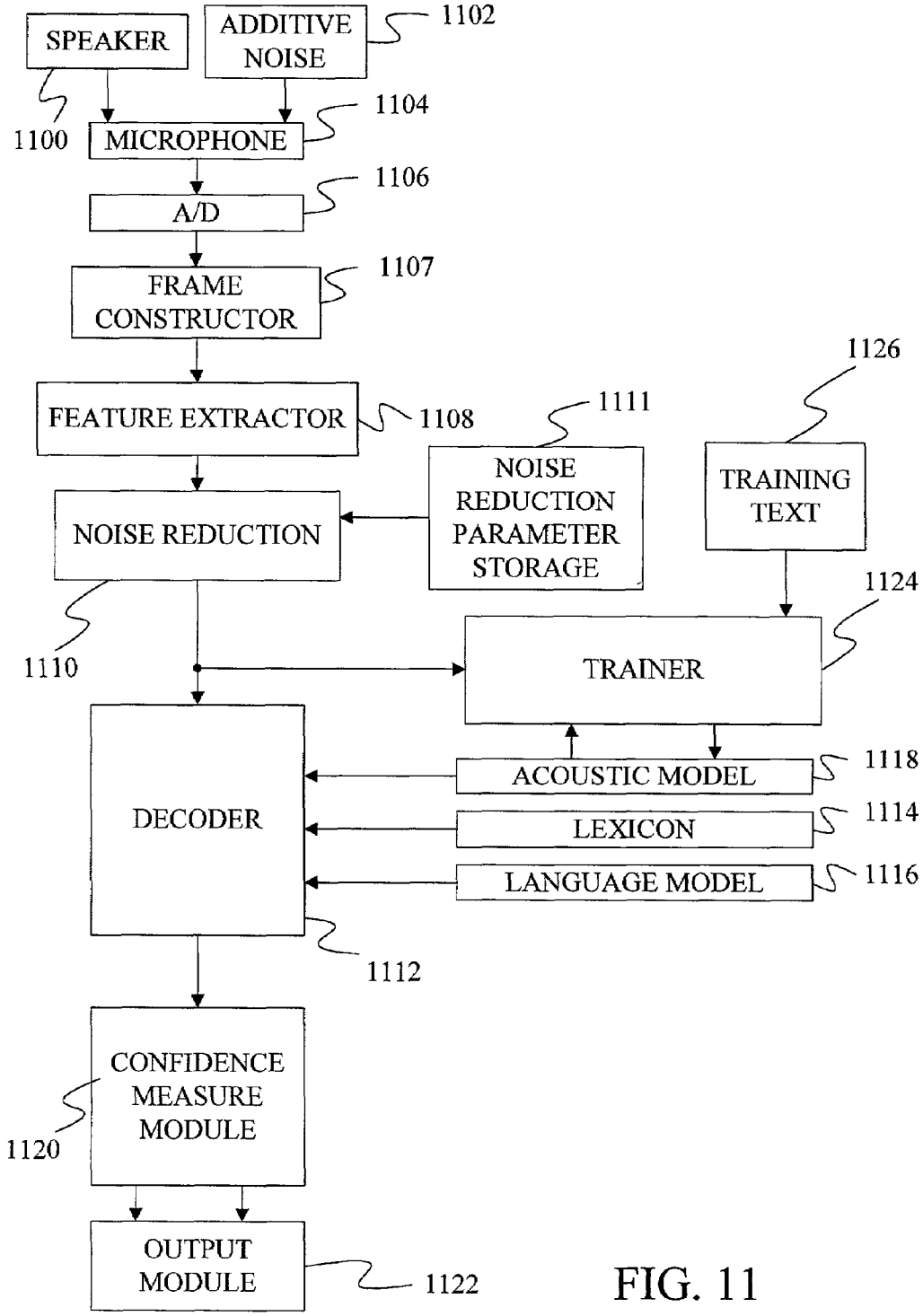
FIG. 11 is a block diagram of a pattern recognition system in which the present invention may be used.

FIG. 11 provides a block diagram of an environment in which the noise reduction technique of the present invention may be utilized. In particular, FIG. 11 shows a speech recognition system in which one or more of the noise reduction techniques of the present invention can be used to reduce noise in a training signal used to train an acoustic model and/or to reduce noise in a test signal that is applied against an acoustic model to identify the linguistic content of the test signal.

In FIG. 11, a speaker 1100, either a trainer or a user, speaks into a microphone 1104. Microphone 1104 also receives additive noise from one or more noise sources 1102. The audio signals detected by microphone 1104 are converted into electrical signals that are provided to analog-to-digital converter 1106.

Although additive noise 1102 is shown entering through microphone 1104 in the embodiment of FIG. 11, in other embodiments, additive noise 1102 may be added to the input speech signal as a digital signal after A-to-D converter 1106.

A-to-D converter 1106 converts the analog signal from microphone 1104 into a series of digital values. In several embodiments, A-to-D converter 1106 samples the analog signal at 16 kHz and 16 bits per sample, thereby creating 32 kilobytes of speech data per second. These digital values are provided to a frame constructor 1107, which, in one embodiment, groups the values into 25 millisecond frames that start 10 milliseconds apart.

The frames of data created by frame constructor 1107 are provided to feature extractor 1108, which extracts a feature from each frame. The same feature extraction that was used to train the noise reduction parameters (the correction vectors, means, and standard deviations of the mixture components) is used in feature extractor 1108.

The feature extraction module produces a stream of feature vectors that are each associated with a frame of the speech signal. This stream of feature vectors is provided to noise reduction module 1110 of the present invention, which uses the noise reduction parameters stored in noise reduction parameter storage 1111 to reduce the noise in the input speech signal using one or more of the techniques discussed above.

The output of noise reduction module 1110 is a series of "clean" feature vectors. If the input signal is a training signal, this series of "clean" feature vectors is provided to a trainer 1124, which uses the "clean" feature vectors and a training text 1126 to train an acoustic model 1118. Techniques for training such models are known in the art and a description of them is not required for an understanding of the present invention.

If the input signal is a test signal, the "clean" feature vectors are provided to a decoder 1112, which identifies a most likely sequence of words based on the stream of feature vectors, a lexicon 1114, a language model 1116, and the acoustic model 1118. The particular method used for decoding is not important to the present invention and any of several known methods for decoding may be used.

The most probable sequence of hypothesis words is provided to a confidence measure module 1120. Confidence measure module 1120 identifies which words are most likely to have been improperly identified by the speech recognizer, based in part on a secondary acoustic model (not shown).

Confidence measure module 1120 then provides the sequence of hypothesis words to an output module 1122 along with identifiers indicating which words may have been improperly identified. Those skilled in the art will recognize that confidence measure module 1120 is not necessary for the practice of the present invention.

Although FIG. 11 depicts a speech recognition system, the present invention may be used in any pattern recognition system and is not limited to speech.

Although the present invention has been described with reference to particular embodiments, workers skilled in the art will recognize that changes may be made in form and detail without departing from the spirit and scope of the invention.

What is claimed is:

1. A method for reducing noise in a noisy input signal, the method comprising:

converting a frame of the noisy input signal into an input feature vector;

selecting a mixture component of a trained model based at least in part on the input feature vector;

identifying a correction vector that incorporates dynamic aspects of a pattern signal based on the selected mixture component, the correction vector having at least one delta coefficient; and adding the correction vector to the input feature vector to form a clean feature vector.

2. The method of claim 1 wherein identifying a correction vector further comprises identifying a correction vector having at least one acceleration coefficient.

3. The method of claim 2 wherein the input feature vector and the clean feature vector each have at least one delta coefficient and at least one acceleration coefficient.

4. The method of claim 1 wherein converting a frame of the noisy input signal further comprises converting a set of n frames of the noisy input signal into n input feature vectors, selecting a mixture component further comprises selecting a mixture component based at least in part on the n input feature vectors, and adding the correction vector to the input feature vector comprises adding the correction vector to one of the feature vectors in the set of n feature vectors.

5. The method of claim 1 wherein identifying a correction vector comprises selecting a correction vector based on the selected mixture component and filtering the correction vector relative to time.

6. The method of claim 5 wherein filtering the correction vector comprises filtering a sequence of correction vectors.

7. The method of claim 6 wherein filtering the sequence of correction vectors comprises applying the sequence of correction vectors to a time-invariant filter.

* * * * *